US005690300A

United States Patent [19]

Iannucci

[11] Patent Number: 5,690,300

[45] Date of Patent: Nov. 25, 1997

[54] INTERLOCKED CORE SHAFT

[75] Inventor: Don Iannucci, Jamaica Plain, Mass.

[73] Assignee: Double E. Company, Inc.

[21] Appl. No.: 694,767

[22] Filed: Aug. 9, 1996

[51] Int. Cl.[6] ..... B65H 75/22; B65H 75/24

[52] U.S. Cl. ..... 242/571.2; 242/599; 242/609.1; 492/38

[58] Field of Search ..... 242/571.2, 609.1, 242/609.2, 609.3, 596.7, 597.5, 599, 571, 118, 118.1, 118.11, 118.2, 118.3, 118.31, 118.32; 279/2.07, 2.08; 269/48.1; 492/4, 38

[56] References Cited

U.S. PATENT DOCUMENTS

| | | | |
|---|---|---|---|
| 662,046 | 11/1900 | Winter | 492/38 |
| 825,674 | 7/1906 | Oberbeck | 242/609.1 |
| 969,652 | 9/1910 | Parker | 492/38 |
| 4,124,173 | 11/1978 | Damour | 242/571.2 |
| 4,176,804 | 12/1979 | Nemoto et al. | 242/609.1 |
| 4,991,791 | 2/1991 | Cocito | 242/571.2 |
| 5,253,816 | 10/1993 | Kastingschafer et al. | 492/38 |

FOREIGN PATENT DOCUMENTS

| | | | |
|---|---|---|---|
| 2132823 | 1/1972 | Germany | 242/571.2 |
| 16661 | 6/1907 | United Kingdom | 242/609.1 |

OTHER PUBLICATIONS

Dyna–Grip Metal Bladder Shafts brochure, Double E Company, Inc., West Bridgewater, MA.

Series 100 Shaftless Single Roll Unwind/Rewind Stand brochure, McBride Machine Corp., Danville, PA.

Expanding Air Shafts brochure, International Expanding Shafts SRL, San Giuliano Milanese, Italy.

Rotocoat Extruder brochure, Rotomec America, Incorporated, West Hartford, CT.

*Primary Examiner*—John M. Jillions

*Attorney, Agent, or Firm*—Hale and Dorr LLP

[57] ABSTRACT

A core or a core shaft is formed from a plurality of identical, extruded pieces. Each piece has complementary grooves on opposite sides, so that the pieces interlock. Each piece extends the length of the core or core shaft. The pieces are held together by a series of pins and are connected to a core shaft journal or a core cap by a series of screws that fit into receptacles in the pieces. When used as a core shaft, each piece includes a channel for a bladder.

19 Claims, 6 Drawing Sheets

INTERLOCKED CORE SHAFT

FIELD OF THE INVENTION

This invention relates to cores and core shafts.

BACKGROUND OF THE INVENTION

In manufacturing and other operations, a roll of material (e.g., paper, cloth, or metal sheeting) may need to be mounted onto a roll stand for winding the material onto or off the roll. The material is wound around a core and the core is typically mounted onto a core shaft. Typically, the core shaft contains an inflatable bladder. When inflated, the bladder locks the core to the core shaft. A variety of methods may be used to lock the core to the core shaft, including the use of lugs that are pushed outward from the core shaft and against the core. At times, a separate leaf piece may be attached to each lug piece with a series of screws.

The core shaft often is made from tubular aluminum or steel. The core often is made from paper fiber or metal tubing.

As the diameter of the core increases, the weight and cost of the core shaft increases greatly. With increased weight, it is more difficult to move or replace a core shaft.

While cores made from paper do not suffer from the same weight problems as aluminum or steel core shafts, they are easily damaged and in many cases are not reusable.

SUMMARY OF THE INVENTION

According to the present invention, these and other problems and disadvantages are corrected by using a core or a core shaft made from a number of interlocking, extruded pieces. The extruded pieces are lightweight yet as a result of the deep cross-section of the extruded sections are very strong. They may be easily manufactured.

Preferably, the core or core shaft is made from six identical extruded pieces, each of which extends the length of the core or core shaft and one sixth of the circumference. However, the core shaft could be made from fewer or more than six pieces. Preferably, the pieces are made from aluminum, but steel, plastic, or other extrudable materials may be used.

Preferably, the pieces interlock through the use of complementary projections and grooves at the ends of the inner side of each piece. For example, the right side of each piece may have a projection and a groove facing toward the outer diameter of the piece, and the left side may have a projection and a groove facing toward the inner diameter of the piece, so that the projection on the left side of one piece fits into the groove on the right side of an adjoining piece and the projection on the right side of the piece fits into the groove on the left side of an adjoining piece. Alternatively, the grooves could be on the outer side of each piece or other interlocking schemes could be used.

The pieces may be held together with a series of pins that are inserted at either end of the core or core shaft. Preferably, there are two pins per piece (one at each end) and a rod extends between the inner ends of the pins on either end of the core or core shaft.

At least when used as a core shaft, each piece preferably includes space for a bladder and a receptacle for receiving at least one screw, so that the core shaft may be connected to the journal. When inflated, the bladder forces out a leaf that grips the core. Preferably, the leaf is also extruded.

When used as a core, the pieces may be capped at each end. The core is lightweight, strong, rigid, and reusable.

DETAILED DESCRIPTION OF PREFERRED EMBODIMENTS

Figure 1:
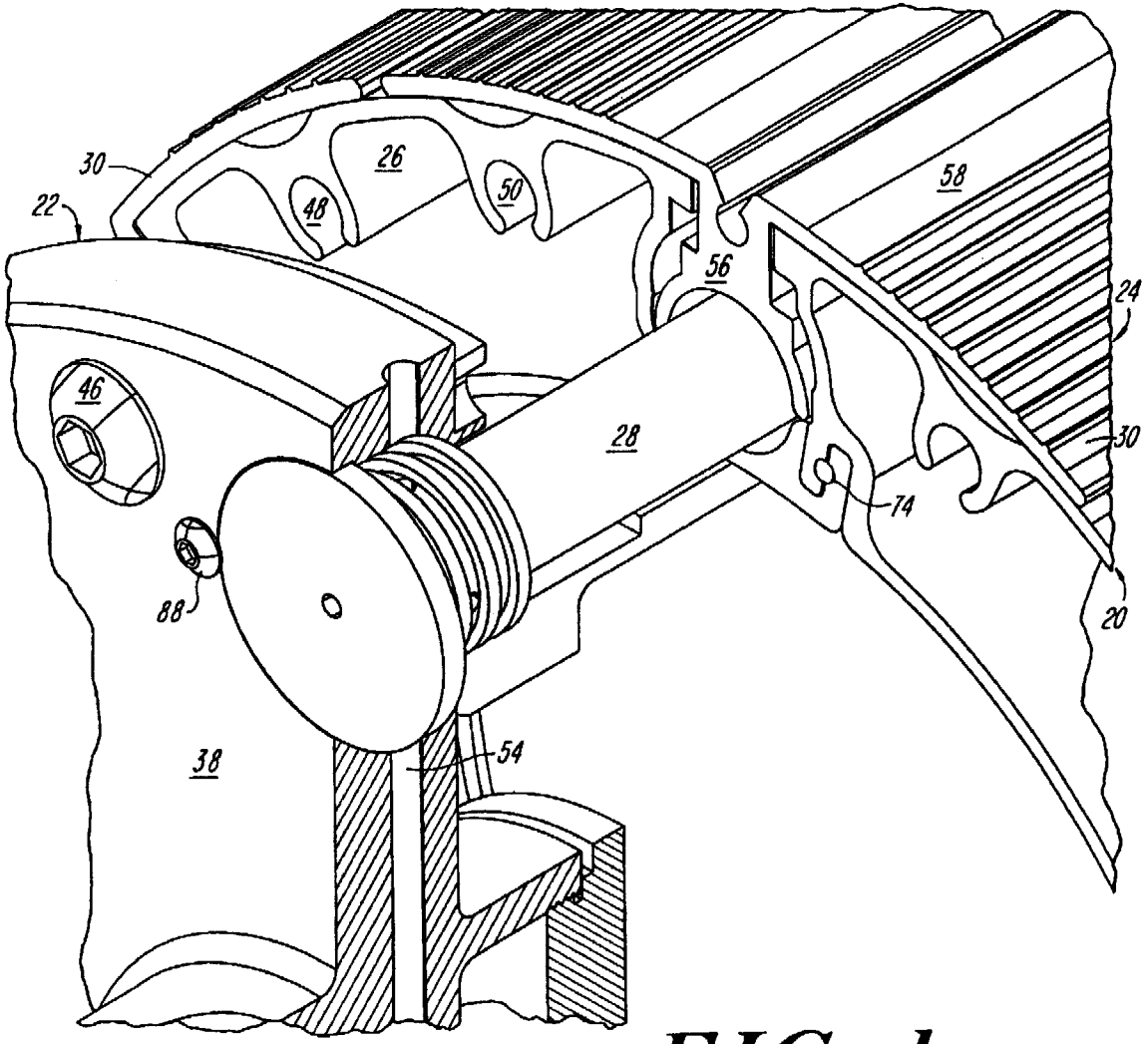
FIG. 1 is a cutaway perspective view of a core shaft assembly of the present invention.
Figure 2:
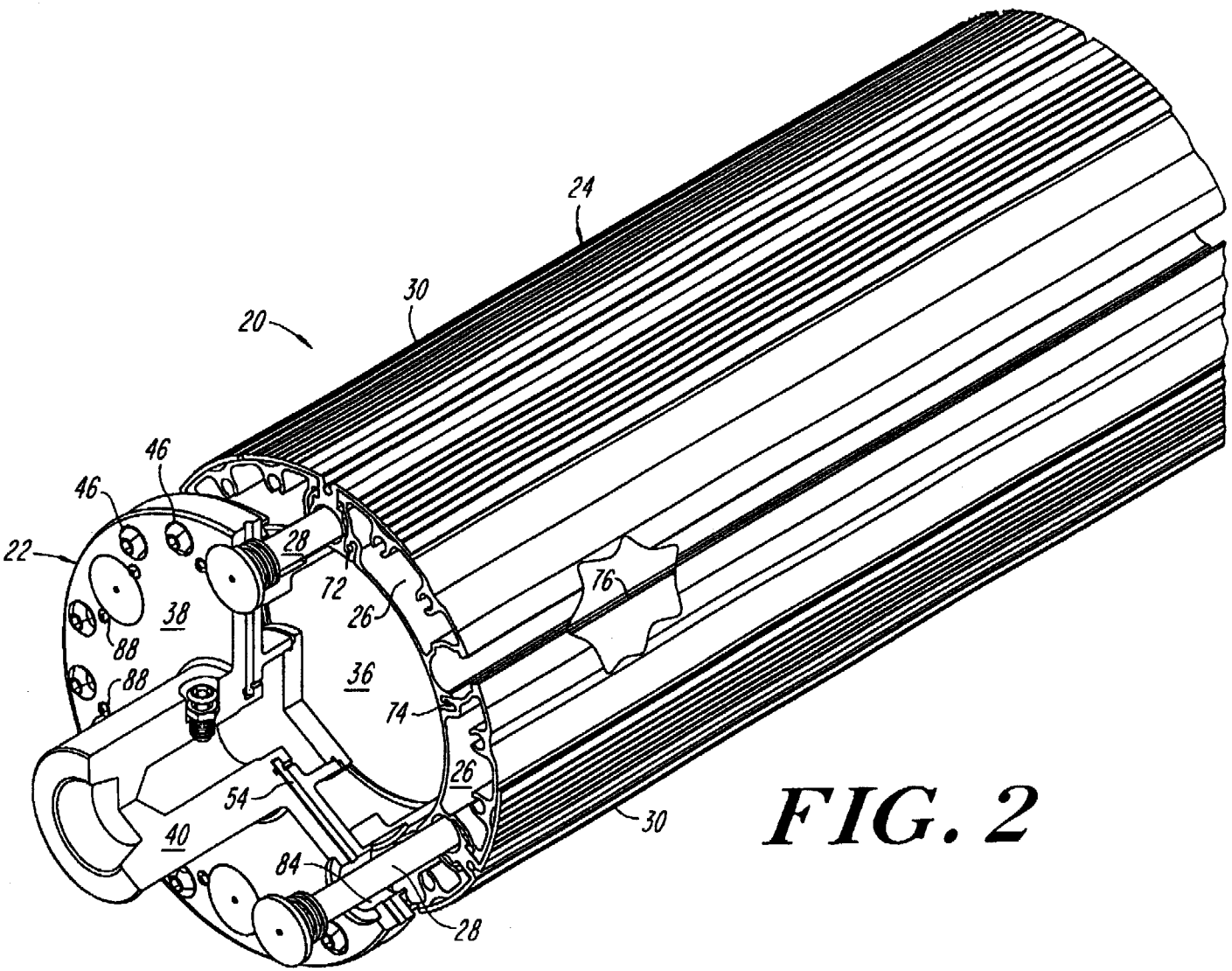
FIG. 2 is a cutaway perspective view of a core shaft assembly of the present invention.

Referring to FIGS. 1 and 2, core shaft assembly 20 includes journal assembly 22 and core shaft 24. Core shaft 24 includes six interlocking core lengths 26, a bladder assembly 28 between each core length 26, and a leaf 30 extending outward from each bladder assembly 28. Core length 26 and leaf 30 are extruded aluminum.

Journal assembly 22 includes insertion tube 36, end cap 38, and journal 40. Journal 40 connects core shaft assembly 20 to a stand (not shown). Core shaft 24 surrounds insertion tube 36. Although only one journal assembly 22 is shown, it is understood that core shaft assembly 20 includes a journal assembly 22 at each end.

Core shaft 24 typically has an outer diameter of 8 to 16 inches and an inner diameter approximately one and half to two inches less than the outer diameter. Generally, the strength of core shaft 24 increases when the radial length of core shaft 24 is increased. The length of core shaft 24 may vary greatly, but is typically on the order of 10 feet.

Each core length 26 is connected to end cap 38 by two screws 46, which fit into threaded receptacles 48 and 50. Although receptacles 48 and 50 extend the length of each core length 26, the space between the ends of opposite screws 46 remains empty. Alternatively, fewer or a greater number of screws 46 can be used to connect core lengths 26 to end cap 38, or other known methods can be used to connect the set of core lengths to end cap 38.

Figure 3:
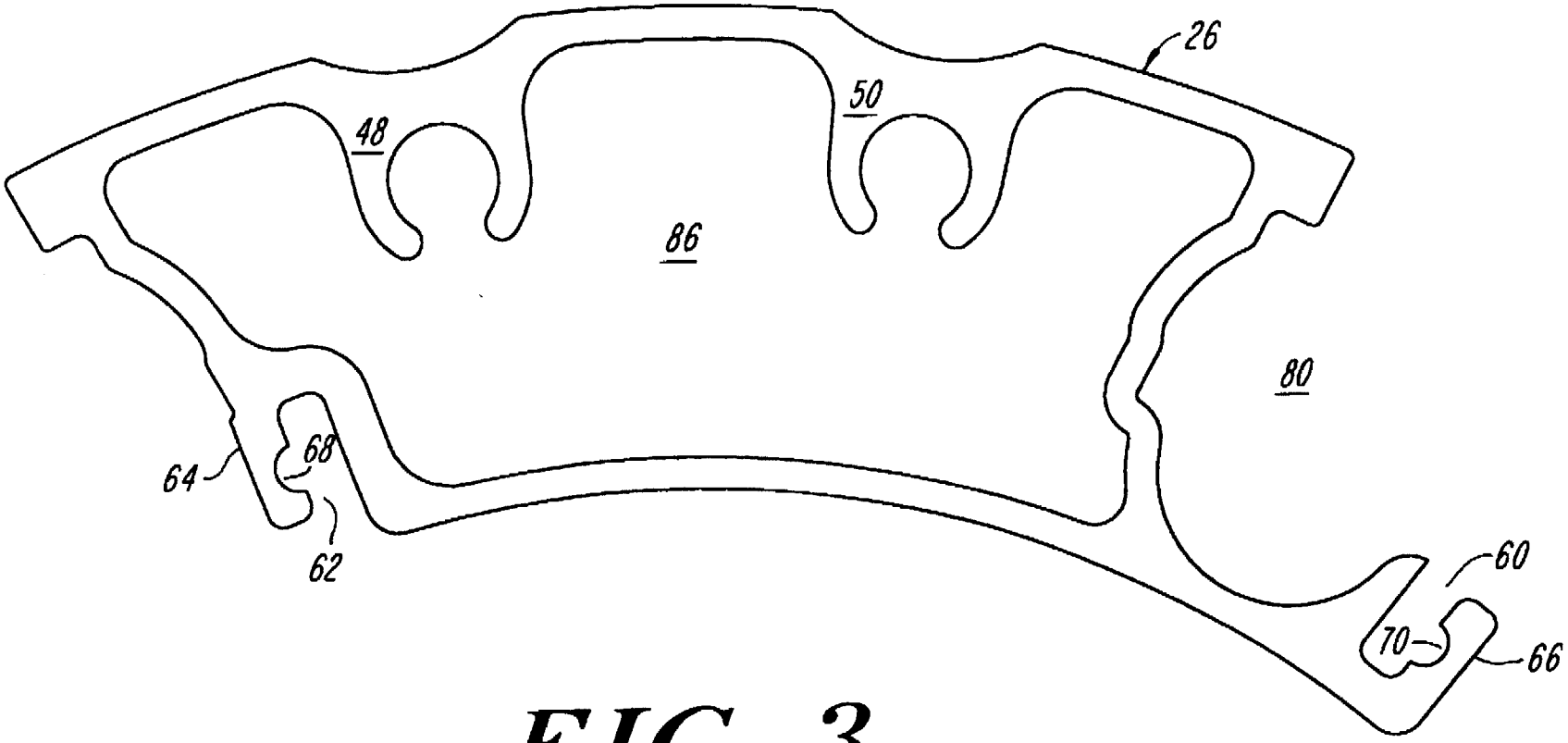
FIG. 3 is an end view of a single extruded piece of a core shaft of the present invention.
Figure 4:
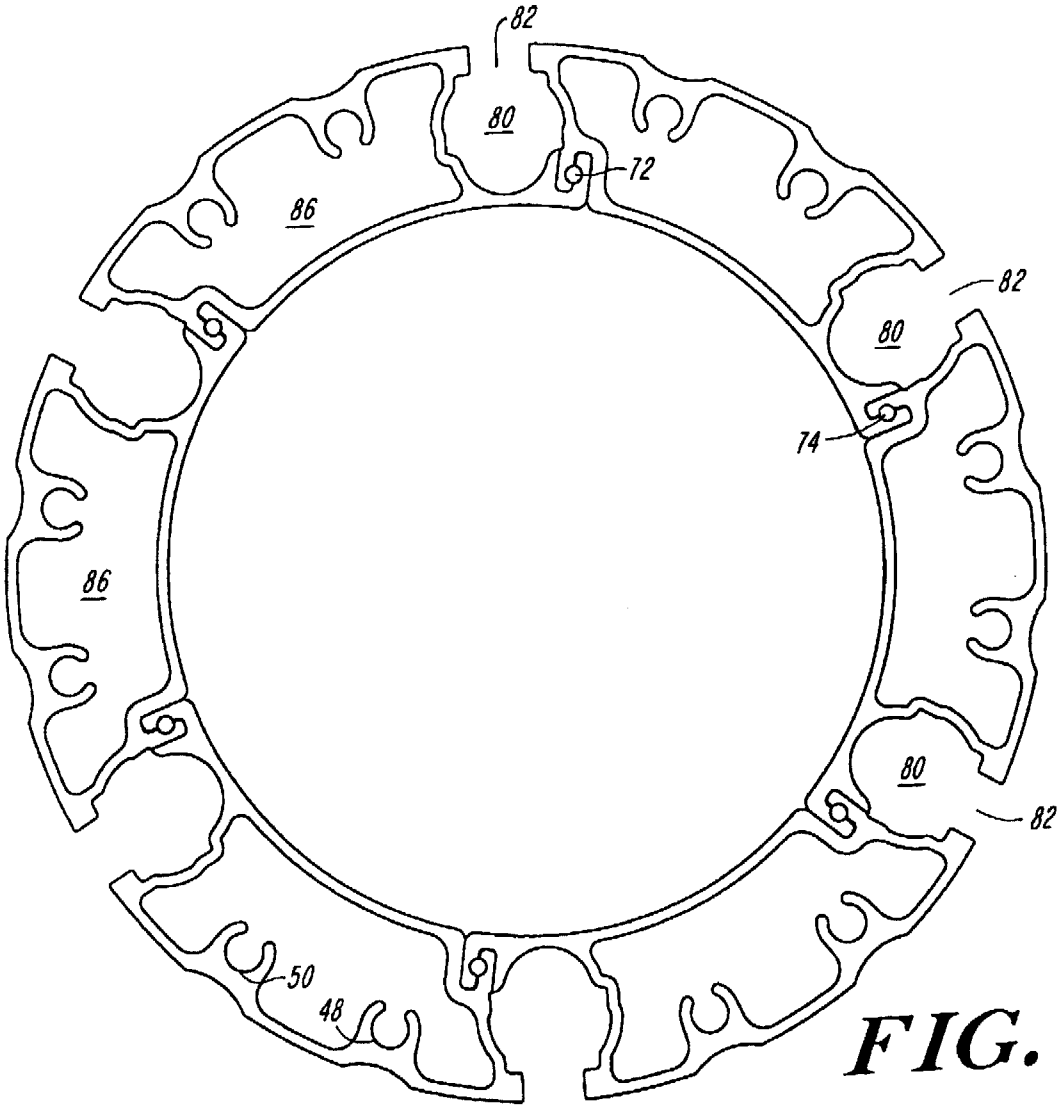
FIG. 4 is an end view of a core shaft of the present invention.

Referring also to FIGS. 3 and 4, each core length 26 includes along its inner diameter an outward facing groove 60 at its right side and a complementary inward facing groove 62 at its left side. Inward facing projection 64, which forms one wall of groove 62 on the left side of core length 26, fits into groove 60 of the adjoining core length 26. Outward facing projection 66, which forms one wall of groove 60 on the right side of core length 26, fits into groove 62 of the adjoining core length 26. Projections 64 and 66 include complementary semi-circular notches 68 and 70, positioned so that when adjoining core lengths 26 are fitted together, the notches create core channel 72. Pins 74 are inserted into the ends of each core channel 72, to lock each core length 26 together. Preferably, each pin 74 is approximately 3 inches long. In a preferred embodiment, one or more rods 76 are inserted into the middle portion of each core channel 72.

The right side of each core length 26, when fitted into the left side of the adjoining core length 26 forms a bladder channel 80, which is closed except along a gap 82 in the outer side of core shaft 24. Each bladder assembly 28 fits into a bladder channel 80 and is held in place in opening 84 in end cap 38 with screws 88, which fit over a portion of the ends of bladder assembly 28. Alternatively, opening 84 may be threaded, so as to receive the end of each bladder assembly 28. Each bladder assembly 28 is inflated through inner channel 54. Methods for inflating and deflating bladders 28 are well known in the art.

Leaf 30 includes a radial section 56, which extends outward from core shaft 24 from inside bladder channel 80 through gap 82, and a gripping section 58. Each leaf 30 is a single extruded piece. Preferably, radial section 56 and gripping section 58 are each continuous from one end of leaf 30 to the opposite end of leaf 30.

Preferably, when bladder 28 is deflated, the inner side of gripping section 58 touches core shaft 24. When inflated, bladder assembly 28 forces leaf 30 outwards, so that gripping section 58 grips a core (not shown). In a preferred embodiment, when bladder assembly 28 is inflated, gripping section 58 is separated from the outward side of core shaft 24 by approximately 0.25 inches.

Through the middle of each core length 26 is inner channel 86. Preferably, the sides of core length 26 around inner channel 86 are in most places approximately one eighth inch thick.

Figure 5:
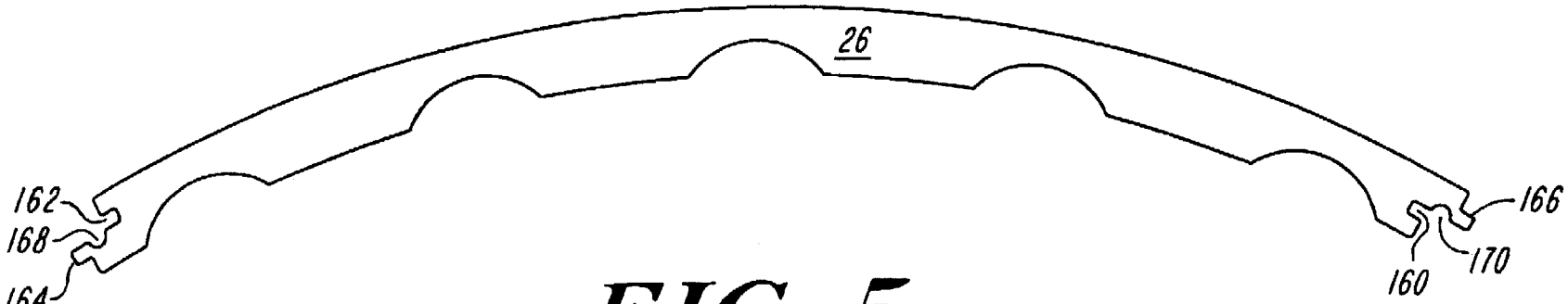
FIG. 5 is an end view of a single piece of a core of the present invention.
Figure 6:
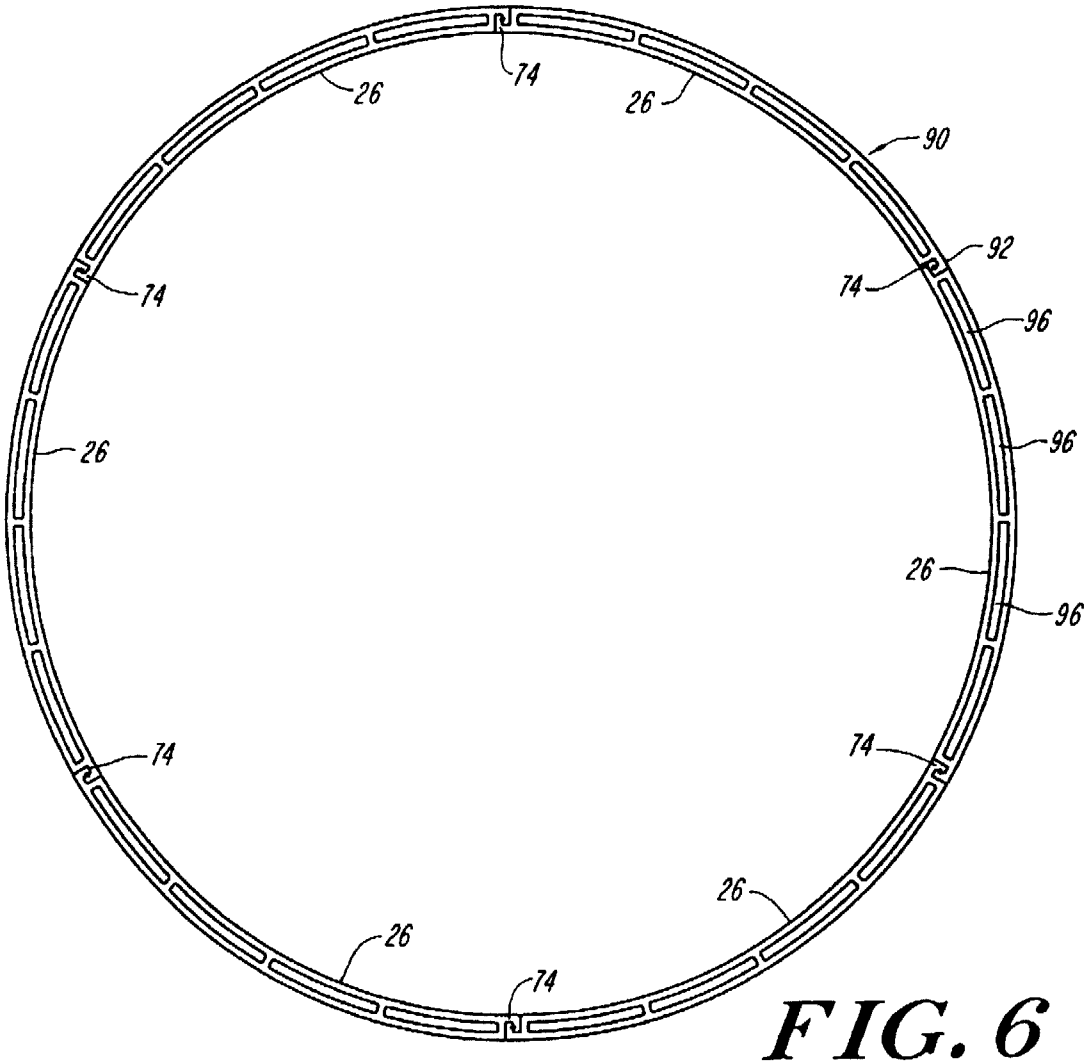
FIG. 6 is an end view of a core of the present invention.

FIGS. 5 and 6 show two different designs for the interlocking core lengths 126 of a reusable core 90. Core lengths 126 are locked together with pins 74, and together form core tube 92. Core lengths 126 and pins 74 are similar to the core lengths 26 described above, but without bladder channels 80 and preferably without receptacles 48 or 50 for screws from an end plate. In the embodiment shown in FIG. 5, each core length 126 includes laterally facing groove 160 on its right side and laterally facing groove 162 on its left side. Complementary projections 164, on the left side of core length 126, and 166, on the right side of core length 126, fit into grooves 160 and 162. Projections 164 and 166 include complementary semi-circular notches 168 and 170, positioned so that when adjoining core lengths 126 are fitted together, the notches create core channels into which pins 74 fit. Core lengths 126 are sized so that the inner diameter of core tube 92 fits over the outer diameter of a core shaft. As shown in FIG. 6, core lengths 126 may include inner channels 96. Although three inner channels 96 are shown in FIG. 6 for each core length 126, a different number may be used.

Optionally, the ends of core 90 may be covered by caps. In that case, each cap preferably is an extruded ring extending from the inner diameter of core tube 92 to the outer diameter of core tube 92, with an appearance like that of the outer portion of end cap 38, shown in FIGS. 1 and 2. Each core length 126 may be connected to the caps by two screws, in the same manner as described above with the core shaft. Alternatively, other known methods can be used to connect core tube 92 to the caps.

Although the above invention has been described in terms of a core or a core shaft, it could also be used with other tubes.

While there have been shown and described examples of the present invention, it will be readily apparent to those skilled in the art that various changes and modifications may be made therein without departing from the scope of the invention as defined by the appended claims. Accordingly, the invention is limited only by the following claims and equivalents thereto.

What is claimed is:

1. A core comprising:

a plurality of adjoining core lengths together forming a hollow core tube having an inner diameter and an outer diameter, each core length having an inner side, an outer side, a left side, and a right side; wherein the inner side, the outer side, the left side, and the right side of each core length form a channel extending a length of each core length; and wherein a portion of the left side of each core length fits into a portion of the right side of the adjoining core length; and a plurality of pins, each of the plurality of pins holding together two adjacent core lengths.

2. The core of claim 1, wherein each core length is substantially identical.

3. The core of claim 2, wherein each core length is extruded.

4. The core of claim 3, wherein each core length is extruded aluminum.

5. The core of claim 3, wherein each core length is extruded steel.

6. The core of claim 3, wherein each core length is extruded plastic.

7. The core of claim 3, further comprising a cap connected to an end of the core tube.

8. The core of claim 7, wherein the cap is a ring having an inner diameter approximately the same as the inner diameter of the core tube and an outer diameter approximately the same as the outer diameter of the core tube.

9. A core shaft assembly comprising:

a plurality of adjoining core lengths together forming a hollow core shaft having an internal side and a core side, each core length having an inner side, an outer side, a left side, and a right side; wherein the inner side, the outer side, the left side, and the right side of each core length form a channel extending the length of each core length; and wherein a portion of the left side of each core length fits into a portion of the right side of the adjoining core length; and a journal assembly connected to the core shaft.

10. The core shaft assembly of claim 9, wherein each core length includes a receptacle for receiving a screw and the journal assembly is connected to the core shaft by a plurality of screws each extending through the journal assembly and into the receptacle of one of the core lengths.

11. The core shaft assembly of claim 9, wherein each core length is substantially identical.

12. The core shaft assembly of claim 11, wherein each core length is extruded.

13. The core shaft assembly of claim 9, wherein the core shaft includes a plurality of bladder channels and the core shaft assembly further comprises a plurality of bladders, and wherein each of the plurality of bladders is inserted into one of the plurality of bladder channels.

14. The core shaft assembly of claim 13, wherein each of the plurality of bladder channels includes an opening on the core side of the core shaft.

15. The core shaft assembly of claim 14, wherein each of the plurality of bladder channels includes a first wall formed from the left side of one of the plurality of core lengths and a second wall formed from the right side of another of the plurality of core lengths.

16. The core shaft assembly of claim 13, further comprising a plurality of leaves, each leaf having a radial section extending out of the core shaft from one of the plurality of bladder channels and a gripping section connected to the radial section, wherein each leaf is movable between a contracted position in which the gripping section is separated from the core side of the core shaft by a first distance and an expanded position in which the gripping section is separated from the core side of the core shaft by a second distance, greater than the first distance.

17. The core shaft assembly of claim 11, further comprising a plurality of pins in each end of the core shaft, each of the plurality of pins holding together two adjacent core lengths.

18. The core shaft assembly of claim 17, further comprising a plurality of rods extending through at least a portion of the core shaft, each rod being between a pin at each end of the core shaft.

19. A core shaft assembly comprising:

a plurality of adjoining core lengths together forming a hollow core shaft having an internal side and a core side, wherein the hollow core shaft includes a plurality of bladder channels;

a plurality of bladder assemblies, each inserted into one of the plurality of bladder channels; and a plurality of leaves, each leaf including a single piece having a radial section extending out of the core shaft from one of the plurality of bladder channels and a gripping section extending from the radial section along a portion of the core side of the core shaft.

* * * * *